US006811443B2

(12) United States Patent
Machihara et al.

(10) Patent No.: US 6,811,443 B2
(45) Date of Patent: Nov. 2, 2004

(54) ELECTRONIC COMPONENT HAVING HIGH MECHANICAL STRENGTH AND METHOD OF MANUFACTURING A METAL COVER INCLUDED IN THE ELECTRONIC COMPONENT

(75) Inventors: Daisuke Machihara, Sayama (JP); Joe Motojima, Tachikawa (JP); Masaaki Shimada, Hamura (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/412,949

(22) Filed: Apr. 14, 2003

(65) Prior Publication Data

US 2003/0199199 A1 Oct. 23, 2003

(30) Foreign Application Priority Data

Apr. 18, 2002 (JP) ..... 2002-116456

(51) Int. Cl.[7] ..... H01R 13/648
(52) U.S. Cl. ..... 439/630; 439/607
(58) Field of Search ..... 439/630, 607, 439/382, 629, 631

(56) References Cited

U.S. PATENT DOCUMENTS 6,007,385 A * 12/1999 Wu ..... 439/610
6,203,373 B1 * 3/2001 Lin ..... 439/607
6,206,710 B1 * 3/2001 Chen ..... 438/159
6,478,630 B1 * 11/2002 Hsu ..... 439/680
6,585,535 B2 * 7/2003 Murr et al. ..... 439/331
6,648,694 B2 * 11/2003 Takamori et al. ..... 439/630
2002/0102882 A1 * 8/2002 Tanaka ..... 439/630
2003/0171032 A1 * 9/2003 Kobayashi ..... 439/607

FOREIGN PATENT DOCUMENTS

| | | |
|---|---|---|
| JP | 08-203233 | 8/1996 |
| JP | 2002 42995 | 7/2000 |
| JP | 2001-060471 | 3/2001 |
| JP | 2002-373740 | 12/2002 |

* cited by examiner

*Primary Examiner*—Michael C. Zarroli
(74) *Attorney, Agent, or Firm*—Collard & Roe, P.C.

(57) ABSTRACT

In an electronic component having a frame (11) and a cover (12) coupled to the frame, the cover has a flat plate portion (21) and a reinforcing portion (22) that is bent from one edge of the flat plate portion toward one surface side thereof and extends along such one edge. A plurality of press-fit portions (24) protrude from the flat plate portion towards the one surface side thereof in the neighborhood of the reinforcing portion. The press-fit portions are press-fitted into the frame. The press-fit portions can be formed by applying blanking and bending processes to a portion of the flat plate portion.

12 Claims, 4 Drawing Sheets

ELECTRONIC COMPONENT HAVING HIGH MECHANICAL STRENGTH AND METHOD OF MANUFACTURING A METAL COVER INCLUDED IN THE ELECTRONIC COMPONENT

BACKGROUND OF THE INVENTION

This application claims priority to prior application JP 2002-116456, the disclosure of which is incorporated herein by reference.

The present invention relates to an electronic component such as a card connector, and a method of manufacturing a cover for use in the electronic component.

JP-A-2002-42995 discloses one example of a card connector. The disclosed card connector comprises a frame and a cover that is overlapped with and coupled to the frame. Between the frame and the cover is defined a card receiving region for receiving therein a card having an IC, a memory or the like. In the card receiving region, a plurality of conductive contacts are arranged that are brought into and out of contact with the card. The contacts are fixed relative to the frame. The frame has mounting holes on its surface confronting the cover. On the other hand, the cover has insert tongues each extending from its edge toward the frame. The insert tongues are inserted into the corresponding mounting holes upon overlapping the cover with the frame, whereby the cover is united with the frame. As a result, the cover gives aid to rigidity of the frame so that improvement in mechanical strength of the whole card connector can be expected.

With respect to the card connector of this type, the insert tongues are, in general, formed in the following manner. First, projected portions are formed each extending outward from the edge of a flat plate portion of the cover. Then, shallow slits are formed on the flat plate portion at both sides of each projected portion. Subsequently, each projected portion is bent perpendicularly toward one surface side of the cover, thereby to form an insert tongue. Since the shallow slits are formed on both sides of the projected portion, the projected portion can be easily bent, and further, after the insert tongue is formed by bending the projected portion, the insert tongue is prevented from partly projecting over the edge of the flat plate portion.

However, since the rigidity of each insert tongue is weakened due to the existence of the slits, it is possible that the insert tongue is easily deformed when an external force is applied, or aiding of the rigidity of the frame by the cover becomes insufficient. Further, since the flat plate portion of the cover is small in flexural strength, it tends to cause inconvenience such as occurrence of a warp when the frame receives a deforming force.

SUMMARY OF THE INVENTION

It is therefore an object of the present invention to provide an electronic component having mechanical strength securely improved by a cover which is included in the electronic component.

It is another object of the present invention to provide an electronic component of the type described, wherein not only the strength of a cover, but also the strength of coupling between the cover and a frame are increased.

It is still another object of the present invention to provide a method of manufacturing a cover of the type described.

Other objects of the present invention will become clear as the description proceeds.

According to one aspect of the present invention, there is provided an electronic component having a frame and a cover coupled to the frame, the cover comprising a flat plate portion; a reinforcing portion that is bent from one edge of the flat plate portion toward one surface side thereof and extends along the one edge; and a plurality of press-fit portions each protruding from the flat plate portion toward the one surface side thereof in the neighborhood of the reinforcing portion and press-fitted into the frame, wherein the press-fit portions are formed by applying blanking and bending processes to a portion of the flat plate portion.

According to another aspect of the present invention, there is provided a method of manufacturing a cover for use in the foregoing electronic component, the method comprising a first step of preparing a flat base metal plate; a second step of bending a portion of the base metal plate near one side thereof to form a flat plate portion and a reinforcing portion that is bent from one edge of the flat plate portion toward one surface side thereof and extends along the one edge; and a third step of applying blanking and bending processes to the flat plate portion to form a plurality of press-fit portions each protruding from the neighborhood of the one edge toward the one surface side and press-fitted into a frame included in the electronic component.

DESCRIPTION OF THE PREFERRED EMBODIMENTS

Figure 1:
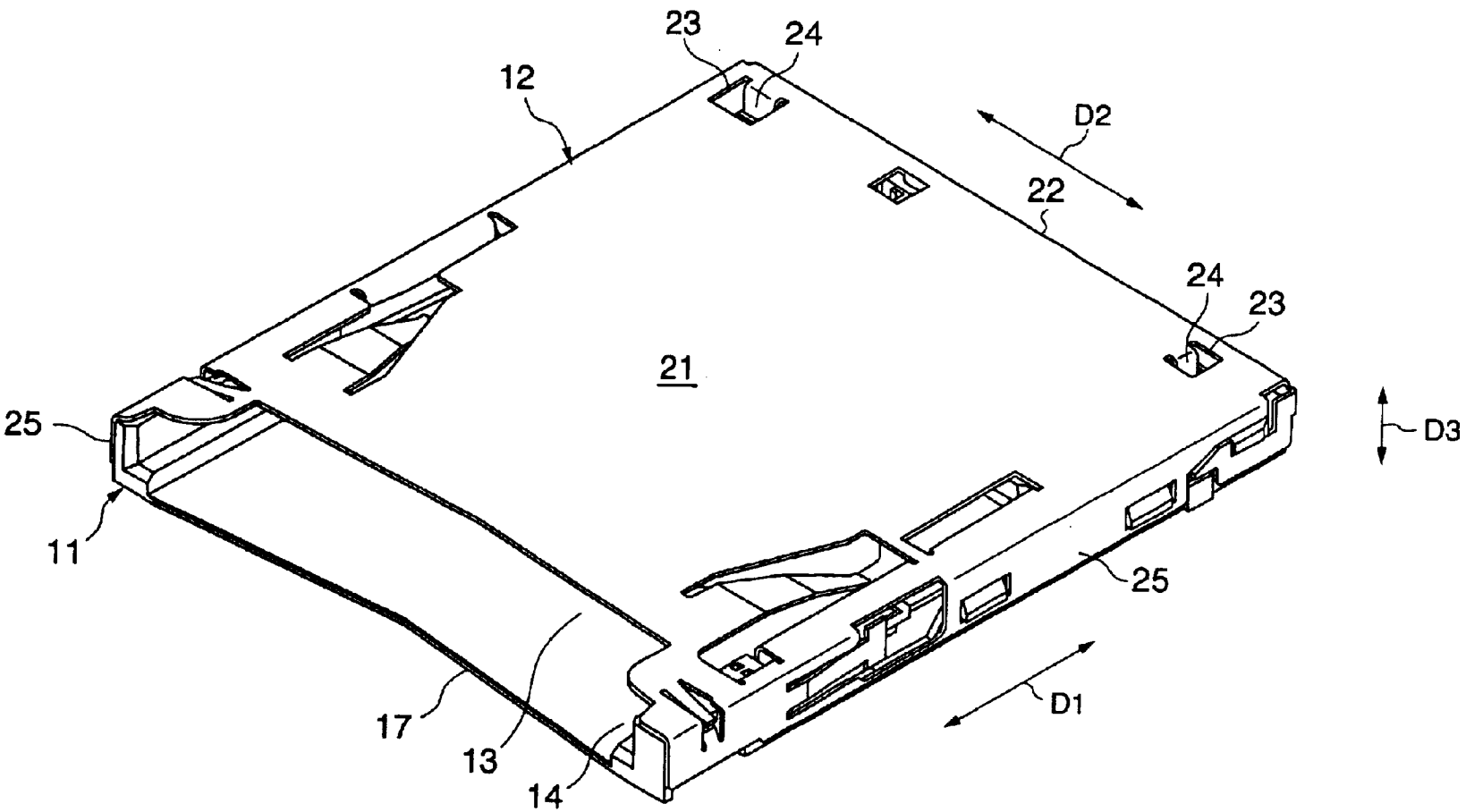
FIG. 1 is an external perspective view of an electronic component according to a first preferred embodiment of the present invention.
Figure 2:
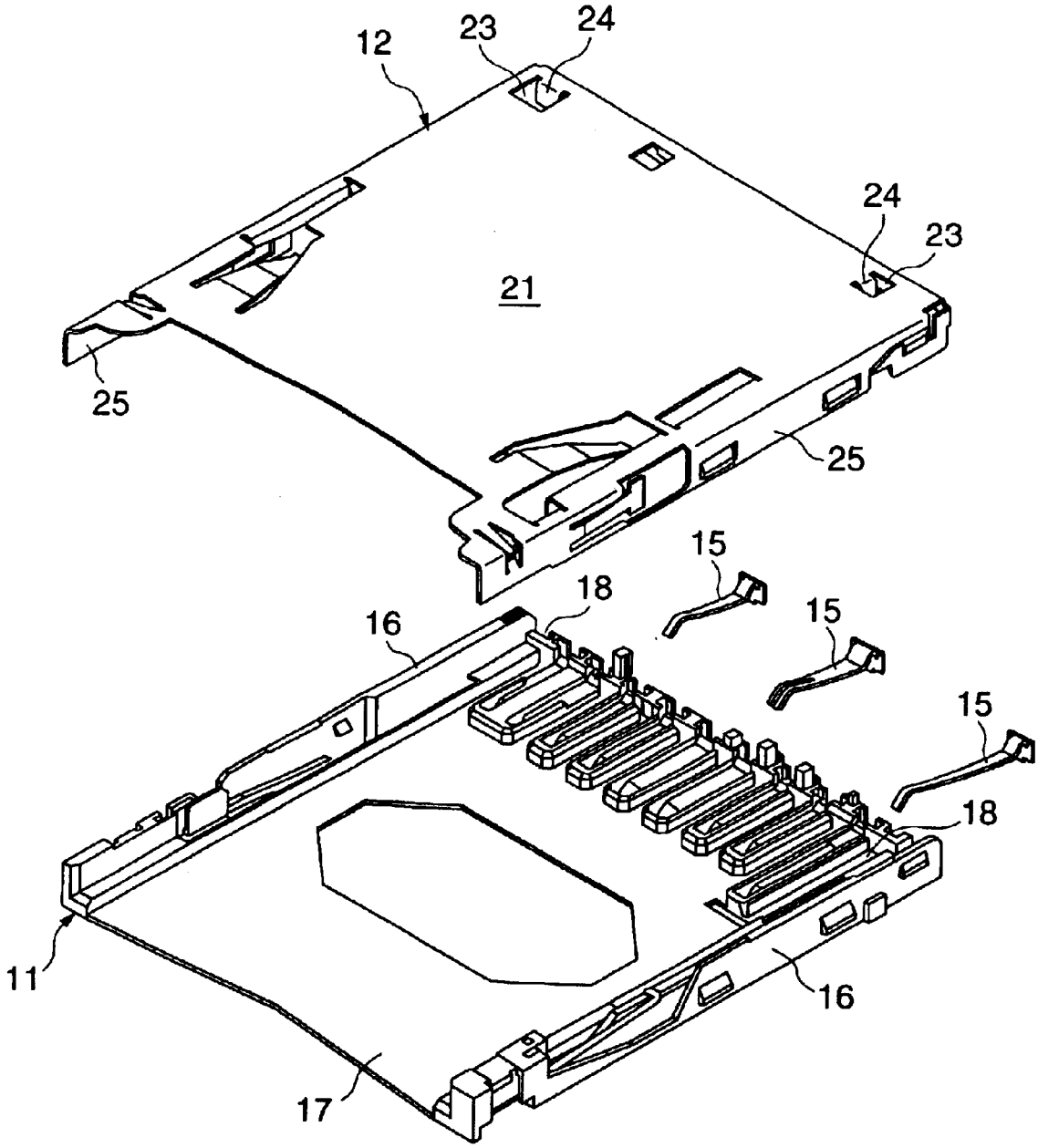
FIG. 2 is an exploded perspective view of the electronic component of FIG. 1.
Figure 3:
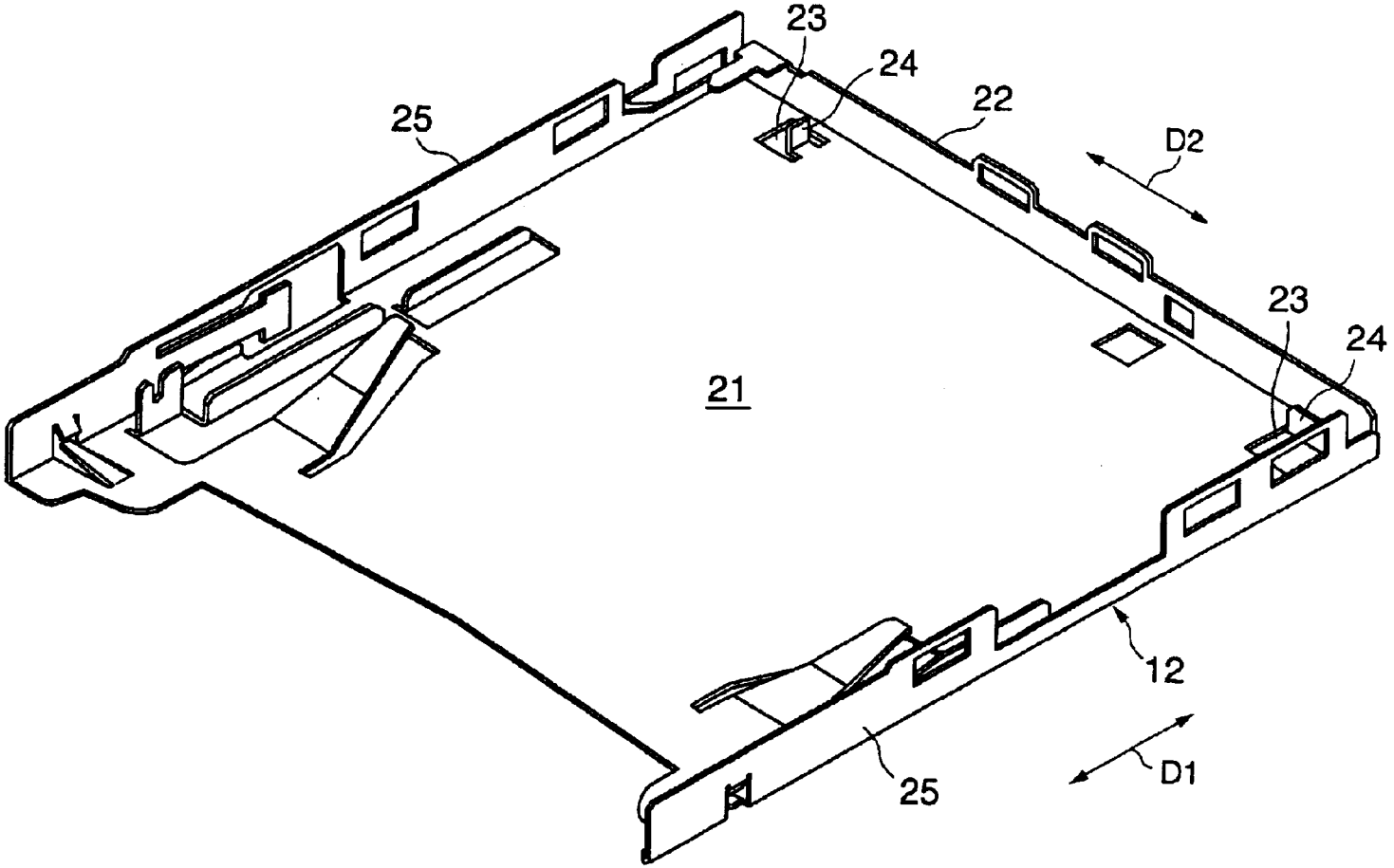
FIG. 3 is a perspective view, seen at an angle different from that in FIG. 2, of a cover of the electronic component of FIG. 1.

Referring to FIGS. 1 to 3, description will be made about an electronic component according to a first preferred embodiment of the present invention.

The shown electronic component is a connector (hereinafter referred to as "IC card connector") that is used for connection of a card (hereinafter referred to as "IC card") having an IC, a memory or the like. The IC card connector comprises a frame 11 made of an insulating material such as plastics, and a metal cover 12 that is overlapped with and coupled to the frame 11. Between the frame 11 and the cover 12 is defined a card receiving region 13 for receiving therein the IC card. The IC card is inserted into and removed from the card receiving region 13 via an opening 14 provided at one end thereof in a first direction D1.

A plurality of conductive contacts (only three contacts are shown for brevity) 15 are arranged in the card receiving region 13 at its other end in the first direction D1. The contacts 15 are brought into and out of contact with the IC card. The contacts 15 are arrayed in a second direction D2 perpendicular to the first direction D1 and fixedly retained to the frame 11.

When the IC card is inserted into the card receiving region 13 in place, the IC card is electrically connected to the contacts 15. On the other hand, when the IC card is removed from the card receiving region 13, the IC card is detached from the contacts 15. As a mechanism for detaching the IC card from the contacts 15, various known mechanisms can be employed.

The frame 11 comprises a pair of side wall portions 16 confronting each other with a space therebetween, and a substantially square bottom wall portion 17 extending between the side wall portions 16 to connect them. The contacts 15 are fixed in the neighborhood of one end of the bottom wall portion 17 in the first direction D1. On an upper surface of the bottom wall portion 17 in the neighborhood of the one end in the first direction D1, three press-fit holes 18 are formed each orienting in a third direction perpendicular to the first and second directions D1 and D2. The press-fit holes 18 are largely spaced apart from each other in the second direction D2.

On the other hand, the cover 12 is formed by pressing a flat base metal plate and has a substantially square flat plate portion 21. The flat plate portion 21 has one edge in the first direction D1 where there is formed, as a reinforcing portion, a bent portion 22 that is bent substantially perpendicularly toward one surface side of the flat plate portion 21, i.e. downward. The reinforcing portion 22 extends along the one edge of the flat plate portion 21 so as to reinforce the flexural strength of the flat plate portion 21. The flat plate portion 21 has two windows 23 in the neighborhood of the reinforcing portion 22. The windows 23 are positioned in the vicinity of two edges of the flat plate portion 21 in the second direction D2, respectively. Two tongue-shaped press-fit portions 24 are formed corresponding to the windows 23, respectively. Each of tongue-shaped press-fit portions 24 protrude perpendicularly from each edge of the windows 23 toward the one surface side of the flat plate portion 21, i.e. downward. The press-fit portions 24 are arranged in positions that are in one-to-one correspondence with those of the press-fit holes 18. Further, the cover 12 has a pair of side wall portions 25 each of which is bent substantially perpendicularly from corresponding one of two edges, in the second direction D2, of the flat plate portion 21 toward the one surface side of the flat plate portion 21, i.e. downward. As described later, each window 23 and each press-fit portion 24 are formed by applying blanking and bending processes to a portion of the flat plate portion 21.

When assembling the IC card connector, the contacts 15 are first mounted onto the frame 11. Then, the cover 12 is overlapped with the frame 11 such that the side wall portions 25 confront the side wall portions 16, respectively. Thereupon, the press-fit portions 24 are press-fitted into the press-fit holes 18, respectively. When the assembling of the IC card connector has been completed, the flat plate portion 21 of the cover 12 confronts the bottom wall portion 17 of the frame 11 with a space defined therebetween, thereby forming the foregoing card receiving region 13 therebetween.

Now, the description will be directed to a method of manufacturing the foregoing cover 12.

First, a square flat base metal plate is prepared. A portion of the base metal plate near one side thereof is bent toward one surface side thereof, thereby to form the square flat plate portion 21 and the reinforcing portion 22 that is united with one edge of the flat plate portion 21. Simultaneously with, before or after the formation of the reinforcing portion 22, blanking and bending processes are applied to the flat plate portion 21 to form the press-fit portions 24.

Preferably, the formation of the press-fit portions 24 is carried out in the following manner. Specifically, U-shaped slits are formed in the flat plate portion 21 near one edge thereof, then tongue-shaped portions inside the slits are bent perpendicularly toward one surface side of the flat plate portion 21, i.e. downward, thereby to form the windows 23 and the press-fit portions 24. It is to be noted that the press-fit portion 24 located near one end in the second direction D2 extends in the second and third directions D2 and D3 and that the press-fit portion 24 located near the other end extends in the first and third directions D1 and D3.

Further, portions near two sides, adjacent to the foregoing one side, of the base metal plate are bent toward the one surface side so as to form the side wall portions 25 confronting each other. The formation of the reinforcing portion 22, the windows 23, the press-fit portions 24 and the side wall portions 25 can be easily carried out with a single press operation.

Figure 4:
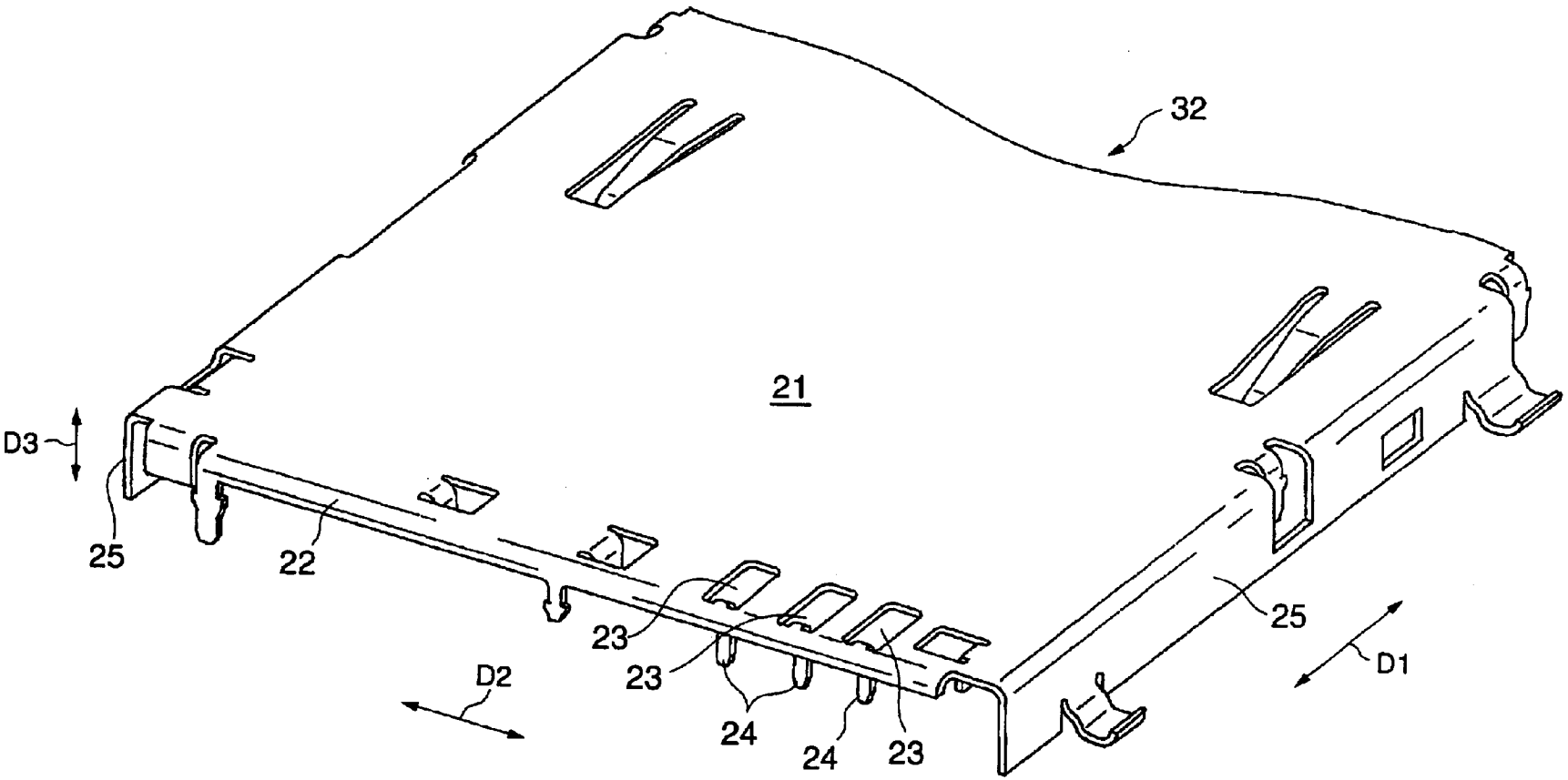
FIG. 4 is a perspective view of a cover that is used in an electronic component according to a second preferred embodiment of the present invention.

Referring to FIG. 4, the description will be made about a cover for use in an electronic component according to a second preferred embodiment of the present invention. Portions or parts having like functions are designated by like reference symbols, thereby to omit explanation thereof.

Also in the cover 32 of FIG. 4, windows 23 of a flat plate portion 21 are formed in the neighborhood of a reinforcing member 22. Press-fit portions 24 are three and extend downward perpendicularly from respective edges of the windows 23. The press-fit portions 24 are press-fitted into three press-fit holes in one-to-one correspondence, each of which is similar to each of the press-fit holes 18 of the IC card connector frame 11 described with reference to FIGS. 1 to 3. In the cover 32, each of the press-fit portions 24 extends in the second and third directions D2 and D3.

While the present invention has thus far been described in connection with a few embodiments thereof, it will readily be possible for those skilled in the art to put this invention into practice in various other manners. For example, although the number of the press-fit portions 24 is set to two or three in the foregoing embodiments, it may be set to other suitable values.

What is claimed is:

1. An electronic component having a frame and a cover coupled to said frame, said cover comprising:

a substantially square flat plate portion;

a pair of side wall portions bent from opposite edges of said flat plate portion and extending along said opposite edges in a direction away from a surface side of said flat plate portion;

a reinforcing portion bent from another edge of said flat plate portion in said direction and extending along the length of said other edge between said opposite edges to reinforce said flat plate portion; and a plurality of press-fit portions each protruding from said flat plate portion in said direction in the neighborhood of said reinforcing portion and press-fitted into said frame, said press-fit portions being formed by applying blanking and bending processes to a portion of said flat plate portion.

2. An electronic component as claimed in claim 1, wherein said flat plate portion has windows in the neighborhood of said reinforcing portion, each of said press-fit portions protruding from an edge of the corresponding window in said direction.

3. An electronic component as claimed in claim 1, wherein said reinforcing portion is substantially perpendicular to said flat plate portion.

4. An electronic component as claimed in claim 1, wherein each of said press-fit portions is substantially perpendicular to said flat plate portion.

5. An electronic component as claimed in claim 1, wherein said frame comprises:

a pair of side wall portions confronting each other with a space therebetween; and a bottom wall portion connecting said side wall portions, said pair of side wall portions are formed of said cover overlapping said side wall portions of said frame.

6. An electronic component as claimed in claim 5, wherein said bottom wall portion has one end confronting said reinforcing portion, and said electronic component further comprises a plurality of conductive contacts retained in the neighborhood of said one end of said bottom wall portion.

7. An electronic component as claimed in claim 6, wherein said bottom wall portion has another end opposite to said one end, said flat plate portion confronting said bottom wall portion with a space left therebetween, said flat plate portion cooperating with the other end of said bottom wall portion to define an opening communicating with said space.

8. An electronic component as claimed in claim 1, wherein said cover is metal.

9. A method of manufacturing a cover included in an electronic component said method comprising:

a first step of preparing a flat base metal plate;

a second step of bending a portion of said base metal plate near one side thereof to form a substantially square flat plate portion and a reinforcing portion that is bent from one edge of said flat plate portion in a direction away from one surface side thereof and extending along said one edge; and a third step of applying blanking and bending processes to said flat plate portion to form a plurality of press-fit portions each protruding from the neighborhood of said one edge in said direction and press-fitted into a frame included in said electronic component.

10. A method as claimed in claim 9, wherein said third step comprises:

forming U-shaped slits in said flat plate portion in the neighborhood of said one edge; and, bending inner portions of said slits in said direction to form said press-fit portions.

11. A method as claimed in claim 9, further comprising a fourth step of bending portions near two sides, adjacent to said one side, of said base metal plate in said direction to form a pair of side wall portions confronting each other.

12. A method as claimed in claim 11, wherein said second, third and fourth steps are executed by a single press operation.

* * * * *

UNITED STATES PATENT AND TRADEMARK OFFICE

CERTIFICATE OF CORRECTION

PATENT NO. : 6,811,443 B2
DATED : November 2, 2004
INVENTOR(S) : Machihara et al.

It is certified that error appears in the above-identified patent and that said Letters Patent is hereby corrected as shown below:

Column 5,
Line 6, after the word "portions" please delete the words "are formed."

Column 6,
Line 15, please delete the comma (,) after the word "and".

Signed and Sealed this

First Day of March, 2005

JON W. DUDAS
*Director of the United States Patent and Trademark Office*